US006220218B1

(12) United States Patent
Saiki

(10) Patent No.: US 6,220,218 B1
(45) Date of Patent: Apr. 24, 2001

(54) ENGINE OPERATION CONTROL DEVICE

(75) Inventor: Suzuhiro Saiki, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/253,751

(22) Filed: Feb. 22, 1999

(30) Foreign Application Priority Data

Feb. 27, 1998 (JP) ..... 10-062042

(51) Int. Cl.[7] ..... F02D 9/08
(52) U.S. Cl. ..... 123/339.19; 123/325
(58) Field of Search ..... 123/339.19, 339.2, 123/339.21, 339.22, 325, 352

(56) References Cited

U.S. PATENT DOCUMENTS

| | | | | |
|---|---|---|---|---|
| 4,506,641 | * | 3/1985 | Hasegawa | 123/339 |
| 4,603,668 | * | 8/1986 | Ueno | 123/352 |
| 5,012,779 | * | 5/1991 | Fukui et al. | 123/339 |
| 5,070,837 | * | 12/1991 | Nishimura et al. | 123/339 |
| 5,181,494 | * | 1/1993 | Ausman et al. | 123/446 |
| 5,415,143 | * | 5/1995 | Togai | 123/339 |
| 5,628,290 | * | 5/1997 | Iida et al. | 123/305 |

FOREIGN PATENT DOCUMENTS

| | | |
|---|---|---|
| 4-019381 | 3/1992 | (JP) . |
| 6-511526 | 12/1994 | (JP) . |

* cited by examiner

*Primary Examiner*—Henry C. Yuen
*Assistant Examiner*—Mahmoud M Gimie
(74) *Attorney, Agent, or Firm*—Browdy and Neimark

(57) ABSTRACT

An engine operation control device which sets higher than the target revolution speed for the idling state the target revolution speed of the engine immediately after the engine operation has shifted to the idling state, to prevent troubles caused by bubbles in the working fluid. When the engine operation shifts to the idling state at time $t_2$, the count value Cnt of the idling counter starts counting. When the count value Cnt reaches the set value Cnt1, the revolution speed correction amount And is added to the target revolution speed for the idling state. The correction amount And progressively decreases with the elapse of time after the engine operation has shifted to the idling state. Because the fuel injection is performed in such a manner as to produce a higher target revolution speed than normal, it is possible to suppress the generation or expansion of bubbles that would otherwise occur under reduced pressure in the injectors used in the fuel injection system as a result of engine operation shift to the idling state.

4 Claims, 10 Drawing Sheets

ENGINE OPERATION CONTROL DEVICE

BACKGROUND OF THE INVENTION

1. Field of the Invention

The present invention relates to an engine operation control device for controlling an engine as it shifts its operating state from a non-idling state to an idling state.

2. Description of the Prior Art

In recent years a variety of electronic control fuel injection systems for diesel engines have been developed which can control a fuel injection pressure as well as a fuel injection amount and a fuel injection timing in order to make further improvements in the engine characteristics involving output and mileage and in the exhaust gas characteristics. Such fuel injection systems for engines have an injector that includes a needle valve, which moves up or down in an injector body to perform an open-close control on injection nozzle holes, and a solenoid valve, which is supplied with a drive current for controlling a working fluid to raise or lower the needle valve. According to an operating condition of the engine, the timing, amount and pressure of the fuel injected from the injector are controlled by a controller.

Among such electronic control fuel injection systems proposed so far are a hydraulically activated system and a fuel pressure activated system. In the hydraulically activated system, an engine oil is used as the working fluid that is pressurized by a high pressure oil pump, the injector has a pressure increasing piston therein which operates on the pressure of the engine oil, and the fuel in a pressure increasing chamber is pressurized by the pressure increasing piston to lift the needle valve, which in turn allows the pressurized fuel to be injected from nozzle holes opened by the needle valve. In the fuel pressure activated system, a high-pressure fuel is used as the working fluid that is pressurized by a high-pressure fuel pump and stored in a common rail, the injector has a pressure control chamber formed in its body and controls the inflow and outflow of the high-pressure fuel into and out of the pressure control chamber to lift or lower the needle valve according to the pressure of the high-pressure fuel, thereby injecting the high-pressure fuel from the nozzle holes opened by the needle valve. In either type of the electronic control fuel injection system, the injector has a solenoid valve, and a controller in the form of an electronic control device controls the timing and duration of supplying a drive current to the solenoid valve to supply the highly pressurized working fluid to the injector, which in turn injects fuel in a predetermined amount at a predetermined timing from nozzle holes formed at the front end of the injector.

Under the non-idling condition a target fuel injection amount is determined based on data, such as a map which is preset so that the engine output characteristic and exhaust gas characteristic remain optimum in response to the engine revolution speed and load (for example, accelerator opening (or the amount by which the accelerator pedal is depressed)). During idling it is desired that the engine revolution remain constant and thus the target fuel injection amount is determined by setting a target revolution speed for the idling operation and performing a PID control, which is based on a difference between the target revolution speed and the engine revolution speed, so that the engine revolution speed matches the target revolution speed. A decision on whether the engine is idling or not is based, for example, on the engine revolution speed and the accelerator pedal depression amount (accelerator opening). The target revolution speed for idling is determined by correcting a basic revolution speed according to the on/off state of an air conditioner and a warming-up switch, the basic revolution speed being set based on data which was determined beforehand according to the engine temperature (for example, a cooling water temperature detected by an engine cooling water temperature sensor). The target fuel injection amount for idling is determined by adding to a basic fuel injection amount set according to the engine temperature a PID correction amount which is obtained based on the revolution speed difference described above. The target fuel injection amount obtained through the correction is injected during idling to prevent cyclic changes and offsets in revolution speed as well as delays in following rapid revolution speed changes.

As one of the electronic control fuel injection systems that adopt an unit injector of the above hydraulically activated type, there is an electronic control fuel injection system disclosed in Published Japanese translations of PCT international publication No. 511526/1994. In this electronic control fuel injection system the pressure of the engine oil as the working fluid is controlled through an electronic device such as solenoid valve installed in the injector to allow simultaneous control of the fuel injection amount and the fuel injection timing.

An injector 50 shown in FIG. 10 includes a nozzle body 52 having nozzle holes 64 for injecting fuel formed at its front end, a solenoid body 53 mounting a solenoid 60 as a solenoid actuator, an injector body 54 and a fuel supply body 55. The injector 50 has a pressure increasing chamber 57 supplied with a fuel from a common rail 63, a pressure chamber 58 supplied with a working fluid, a pressure increasing piston 59 driven by the working fluid supplied to the pressure chamber 58 to pressurize the fuel in the pressure increasing chamber 57, a return spring 71 for resetting the pressure increasing piston 59, and a case 56 formed with a fuel supply port 61 and a fuel discharge port 62, both opening to the common rail 63 to form a fuel chamber 70. In the injector 50 the needle valve 65 is moved up or down by the fuel pressure from the pressure increasing chamber 57 to open or close nozzle holes 64. The pressure increasing piston 59 comprises a large-diameter portion 68, which is slidably fitted in a hole 66 formed in the injector body and forms part of a wall surface of the pressure chamber 58, and a small-diameter portion 69, which is slidably fitted in a hole 67 and forms part of a wall surface of the pressure increasing chamber 57.

The fuel pressurized by a fuel pump to a relatively low pressure is supplied through the common rail 63, the fuel supply port 61 and the fuel chamber 70 into the pressure increasing chamber 57. The fuel in the pressure increasing chamber 57 is pressurized by the pressure increasing piston 59 and delivered from the pressure increasing chamber 57 at a fuel injection pressure. The engine oil as the working fluid that is pressurized by a high-pressure oil pump to a high pressure is accumulated in a high-pressure oil manifold (or an oil rail, see FIG. 9). To actuate the pressure increasing piston 59, the oil rail is connected to the pressure chamber 58 in the injector 50 and a solenoid valve 51 is installed in a hydraulic pressure passage in the injector 50 through which the engine oil is fed. A drive current from the controller energizes the solenoid 60 to operate a valve disc 72 thus opening the solenoid valve 51, with the result that the engine oil is supplied through the hydraulic pressure passage to the pressure chamber 58, as shown by an arrow, acting on a pressure receiving surface of the pressure increasing piston 59 to drive (or stroke) the pressure increasing piston 59. The fuel in the pressure increasing chamber 57 is pressurized by the pressure increasing piston 59 and as the needle valve 65 is moved up or down in the body of the injector 50 by the fuel pressure from the pressure increasing chamber 57, the nozzle holes 64 formed at the front end of the nozzle body 52 are opened or closed to inject the fuel into the combustion chamber through the open nozzle holes 64. Because the injector 50 pressurizes the fuel in the pressure increasing chamber 57 by the pressure increasing piston 59, the fuel injection is carried out at a fuel injection pressure independent of the engine revolution.

Since the fuel injection pressure is determined by the pressure of the working fluid, or the oil rail pressure, acting on the pressure increasing piston 59, the fuel injection pressure can be controlled by controlling a flow control valve incorporated in the high-pressure oil pump to change the oil rail pressure. The flow control valve uses a solenoid valve whose opening degree is controlled by a duty ratio. By controlling the amount of oil fed from the high-pressure oil pump through the flow control valve to the oil manifold, the oil rail pressure can be controlled. The duty ratio, a control quantity of the flow control valve, is determined according to a target rail pressure, which is obtained by correcting a basic target rail pressure by a PID control that is based on the difference between the basic target rail pressure and the actual rail pressure, the basic target rail pressure being determined by the engine operating condition, namely the engine revolution speed and the target injection amount.

As described above, the electronic control fuel injection system of the hydraulically activated type has a controller which calculates the target injection amount, the target injection timing and the target injection pressure (target rail pressure) according to the operating condition of the engine. Based on the respective target values, the controller determines the current supply duration and timing for the solenoid valve in the injector and the duty ratio of a control current output to the flow control valve in the high-pressure oil pump.

In addition to the electronic control fuel injection system of the hydraulically activated type, there has been known a fuel injection system of fuel pressure activated type in which the injector is operated according to the highly pressurized fuel pressure. This type of fuel injection system is disclosed, for example, in Japanese Patent Publication No. 19381/1992. FIG. 12 is a cross section showing an example of the injector used in the fuel pressure activated fuel injection system. This injector performs fuel injection by supplying a high pressure fuel to a pressure control chamber formed on the back pressure side of the needle valve and leaking the high pressure fuel to control the lift of the needle valve.

In this fuel injection system that uses the highly pressurized fuel as a working fluid, the high pressure fuel is stored in the common rail (see reference number 78 in FIG. 11), from which it is supplied through fuel feed pipes 88 to individual injectors 80. The injectors 80 are each connected to the corresponding fuel feed pipe 88 through a fuel inlet joint 90 provided on the upper side portion of the injector 80. Inside an injector body 81 that forms the injector 80 there are formed fuel passages 91, 92. The fuel feed pipe 88 and the fuel passages 91, 92 together form a fuel path. A part of the fuel supplied from the common rail through the fuel path reaches a fuel reservoir 93 formed in a nozzle 82, from which it is forced through a passage surrounding a needle valve 84 slidable in a hole 83 and is injected into the combustion chamber from nozzle holes 85 that are formed at the front end of the nozzle 82 and opened when the needle valve 84 is lifted. The needle valve 84 has a tapered surface 94, which receives the pressure of the high pressure fuel supplied to the fuel reservoir 93, and is subjected to a force produced by the pressure of the high pressure fuel that urges the valve in the lifting direction. Excess fuel is returned to the common rail through a return pipe 89.

The injector 80 has a needle valve lift mechanism of pressure control chamber type to control the lift of the needle valve 84. That is, the high pressure fuel pressurized by the high-pressure fuel pump, in addition to being injected from the nozzle holes 85, is also supplied to a pressure control chamber 100. The injector 80 has a solenoid valve 96 as a control valve in its head portion, which has a solenoid 98 supplied with a drive current as a control signal from the controller 95 via a signal line 97. When the solenoid 98 is energized, an armature 99 is lifted opening an open-close valve 102 provided at the end of a fuel passage 101 as a leakage path, with the result that the fuel supplied from the fuel path to the pressure control chamber 100 is discharged, releasing the high pressure of the fuel from the pressure control chamber 100 through the oil passage 101.

A control piston 104 is installed vertically movable in a center hole 103 formed in a central part of the body of the injector 80. When the solenoid valve 96 is operated, a force urging the control piston 104 downwardly, which is generated by a combination of the reduced pressure in the pressure control chamber 100 and the spring force of the return spring 105, is overcome by a force urging the control piston 104 upwardly, which is generated by the fuel pressure acting on the tapered surface 94 exposed to the fuel reservoir 93 and on the front end portion of the needle valve 84. Hence, the control piston 104 and therefore the needle valve 84 are lifted, allowing the fuel to be injected from the nozzle holes 85. The amount of fuel injected is determined by the fuel pressure in the fuel path and the lift of the needle valve 84 (the amount and duration of the lift). The drive current supplied to the solenoid 98 is a pulse current to perform an open-close control on the open-close valve 102.

Because the fuel injection pressure is determined by the pressure of the high pressure fuel supplied to the injector 80, the fuel injection pressure can be controlled by controlling the flow control valve installed in the high-pressure fuel pump to change the common rail pressure. As in the hydraulically activated system, the flow control valve uses a solenoid valve that is controlled by the duty ratio. Controlling the duty ratio of a control current applied to the flow control valve enables the common rail fuel pressure to be changed and therefore the fuel injection pressure to be controlled.

As described above, the controller in the fuel pressure activated type electronic control fuel injection system calculates, in the same way as in the hydraulically activated system, the target injection amount, the target injection timing and the target injection pressure (target rail pressure) according to the engine operating conditions and, based on the calculated target values, determines the duration and timing of energizing the solenoid valve in the injector and the duty ratio of a control current output to the flow control valve in the high-pressure fuel pump.

In the above fuel injection system, the injection pressure is set low when the load is small and high when the load is large. This is because a high pressure injection when performed at a low load will increase the pre-mixed combustion ratio, increasing engine noise and NOx in exhaust gas, while on the other hand a low pressure injection when performed at a high load will extend the injection duration deteriorating the mileage and increasing smoke in exhaust gas. Therefore, when the engine operation shifts to idling after the load has increased, the working fluid pressure undergoes a sudden fall after being pressurized to a high pressure. During this rapid pressure reduction air content in the working fluid may appear as bubbles.

If these bubbles should enter into the pressure chamber in the hydraulically activated type injector or into the pressure control chamber in the high pressure fuel type injector, the working fluid pressure in the pressure chamber may not be sufficient to push down the pressure increasing piston or the pressure in the pressure control chamber may fail to be released thoroughly, either case of which will reduce the amount of fuel actually ejected from the injector. As a result, during idling, variations occur in the fuel injection amount among the cylinders or among different cycles, causing unpleasant rotary vibrations of the engine, or what may be termed as swaying vibrations. In the system disclosed in Published Japanese translations of PCT international publication No. 511526/1994, bubbles may also get into oil when the oil returning to the oil pan is agitated by the crankshaft during a high speed operation of the engine.

SUMMARY OF THE INVENTION

It is an object of this invention to provide an engine operation control device which, when the engine operation shifts from a non-idling state to an idling state, can prevent a reduction in the working fluid pressure to suppress generation or expansion of bubbles in the working fluid and which, even when bubbles should enter the pressure chamber or pressure control chamber, can swiftly discharge the bubbles from the pressure chamber or pressure control chamber and thereby suppress variations in the fuel injection amount among different cylinders or cycles to prevent unpleasant swaying vibrations.

This invention concerns an engine operation control device which comprises: a target revolution speed calculation means for calculating a target revolution speed of an engine according to an operation state of the engine; and a revolution speed correction means for correcting the target revolution speed of the engine immediately after the engine operation state has shifted from a non-idling state to an idling state so that the target revolution speed will be higher than that which is calculated by the target revolution speed calculation means for the idling state.

This invention also concerns an engine operation control device which comprises: a target injection pressure calculation means for calculating a target injection pressure of an engine according to an operation state of the engine; and an injection pressure correction means for correcting the target injection pressure of the engine immediately after the engine operation state has shifted from a non-idling state to an idling state so that the target injection pressure will be higher than that which is calculated by the target injection pressure calculation means for the idling state.

The revolution speed correction means progressively reduces a revolution speed correction amount with the elapse of time after the engine operation state has shifted to the idling state. In the engine operation control device as the second invention, the injection pressure correction means progressively reduces an injection pressure correction amount with the elapse of time after the engine operation state has shifted to the idling state.

The engine employs a fuel injection system that can regulate the injection pressure of fuel injected from the injectors according to the pressure of the working fluid.

When the engine operation shifts from the non-idling state to the idling state, the engine revolution speed is corrected to a value higher than the target revolution speed normally calculated for the idling state, thereby preventing the engine revolution speed from immediately falling to the normal revolution speed for the idling state. That is, the fuel injection is executed to keep the engine revolution speed high. This increases the rotation inertia, which in turn suppresses swaying vibrations. Because the revolution speed is kept high, the working fluid pressure is also controlled to be relatively high, thus preventing the generation of bubbles that would otherwise be caused by a rapid pressure reduction of the working fluid. Further, because the injection amount is increased to maintain the high revolution speed, even if bubbles should be formed, they will be swiftly discharged from the fluid passage, pressure chamber and pressure control chamber as the working fluid is spent.

Further, when the engine operation shifts from the non-idling state to the idling state, the target injection pressure (working fluid pressure) of the engine is corrected to a value higher than the target injection pressure normally calculated for the idling state. This minimizes the pressure reduction of the working fluid and suppresses the generation of bubbles that would otherwise be caused by rapid pressure reduction of the working fluid. As a result, variations of the actual injection amount are reduced, suppressing the swaying vibrations. The first and second inventions, while they may be implemented independently, can be used in combination to suppress swaying vibrations according to both the engine revolution speed and the injection pressure when the engine operation shifts from the non-idling state to the idling state.

DETAILED DESCRIPTION OF THE EMBODIMENT

Figure 9:
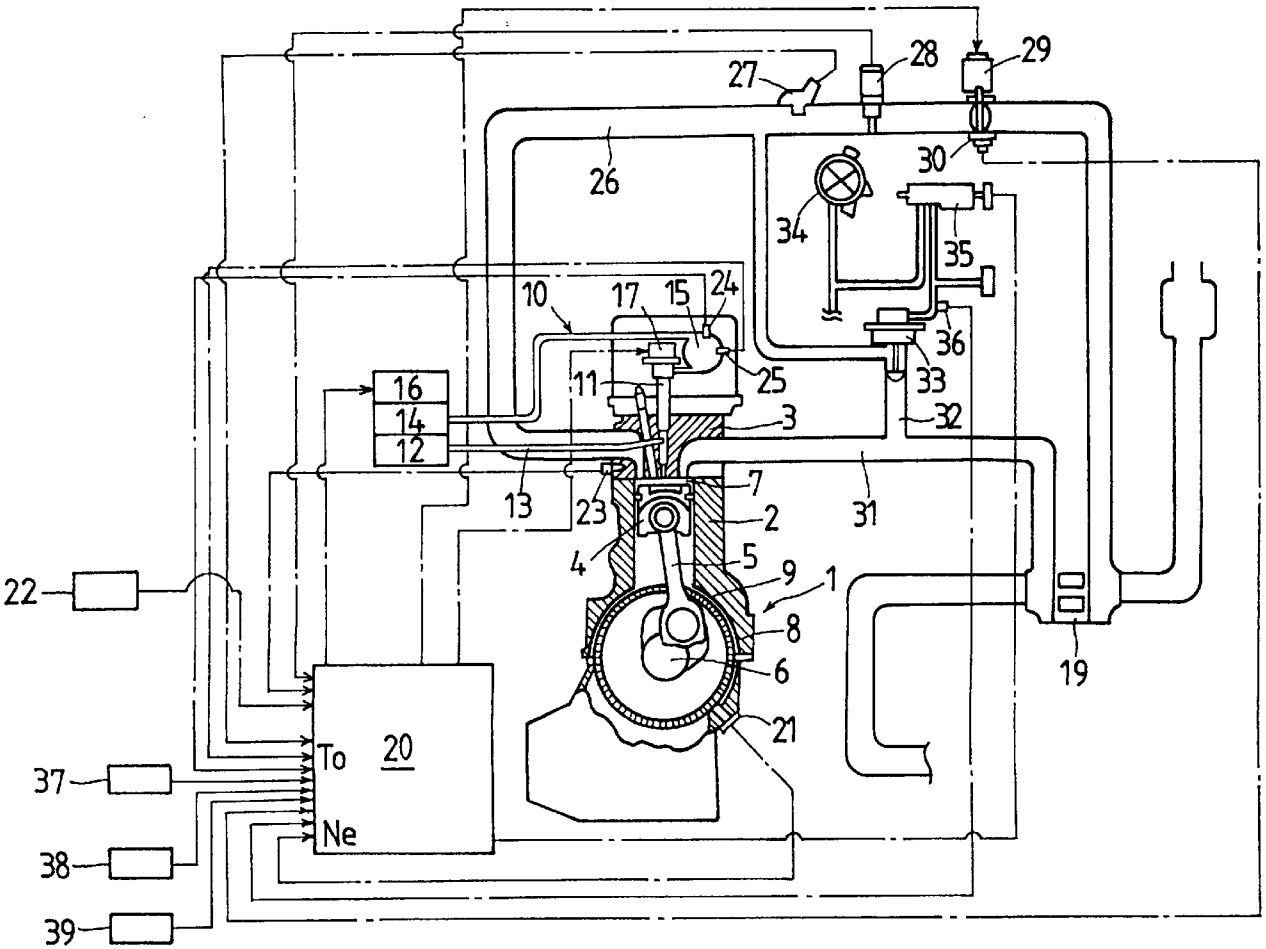
FIG. 9 is a schematic diagram showing one example of a hydraulically activated type electronic control fuel injection system to which to apply the engine operation control device.

By referring to the accompanying drawings one embodiment of the engine operation control device of this invention will be described. An engine 1, although it is shown to have only one injector 11 in FIG. 9, is actually a multicylinder four-cycle direct injection type diesel engine having a plurality of cylinders, for example four cylinders, to produce high outputs. The engine 1 has a cylinder block 2 and a cylinder head 3. The reciprocating motion of a piston 4 slidably driven in a cylinder liner formed in the cylinder block 2 is converted into the rotary motion of a crankshaft 6 through a connecting rod 5 that connects the piston 4 and the crankshaft 6.

Figure 10:
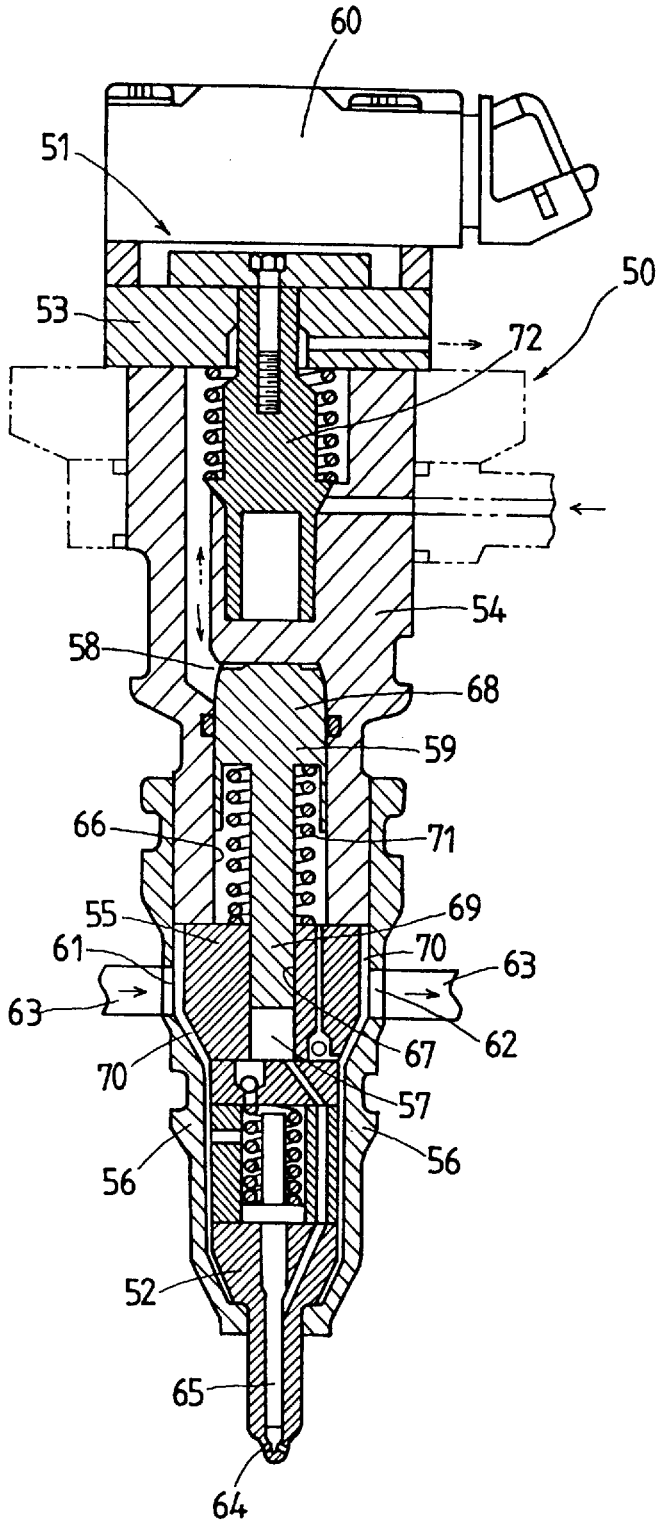
FIG. 10(PRIOR ART)
FIG. 10 is a cross section of one example of a hydraulically activated type injector used in the electronic control fuel injection system.

A hydraulically activated type electronic control fuel injection system 10 in the engine 1 employs an injector 11 similar to a unitized, hydraulically activated type injector 50 of FIG. 10. The injector 11 is installed in the cylinder head 3 and is operated by an engine oil as a working fluid. The injector 11 pressurizes the fuel to a predetermined fuel injection pressure before directly injecting the fuel into a combustion chamber 7. The fuel pressurized by a fuel pump 12 to a relatively low pressure is supplied through a fuel supply pipe 13 to a pressure increasing chamber (reference number 57 in FIG. 10) formed in the injector 11. The engine oil is pressurized by a high-pressure oil pump 14 to a high pressure and accumulated in a high pressure oil manifold (oil rail) 15, from which it is supplied to pressure chambers (reference number 58 in FIG. 10) of individual injectors 11.

The fuel injection pressure is determined by the pressure in the high pressure oil manifold 15, i.e., the oil rail pressure. A flow control valve 16 in the high-pressure oil pump 14 is of normally open type or normally closed type and its opening degree (or an average duration in which the valve is open, i.e., a duty ratio of pulse current) is controlled by a control signal from the controller 20 (described later) to control the amount of oil supplied to the high pressure oil manifold 15 and therefore the oil rail pressure in the high pressure oil manifold 15. The construction of the injector 11 and the fuel injection system having this injector may, for example, use those disclosed in Published Japanese translations of PCT international Publication No. 511526/1994.

The hydraulically activated type electronic control fuel injection system 10 has a controller 20 as an electronic control unit (ECM). The controller 20 receives detection signals from various detection means that monitor the operating conditions of the engine 1. Based on these detection signals, the controller 20 performs control on a solenoid valve 17 of the injector 11 (which corresponds to the solenoid valve 51 of the injector 50 in FIG. 10), the high-pressure oil pump 14, the flow control valve 16 and so on.

In more concrete terms, the detection means for monitoring the operating conditions of the engine 1 to be input to the controller 20 include the following. A crank angle sensor 21 for determining a revolution speed Ne of the engine 1 comprises an electromagnetic pickup that monitors a gear 8 (with teeth 57 at equal intervals) secured to the crankshaft 6 for rotation which has a blank tooth portion 9 (equal in length to three teeth) at one part of its circumference. Based on the number of times that the blank tooth portion 9 (equal in length to three teeth) has been detected in a predetermined period of time, the revolution speed of the crankshaft 6 is determined. An accelerator pedal depression amount sensor 22 to detect an amount by which the accelerator pedal is depressed (or accelerator opening) Ac comprises a potentiometer that measures a stroke of the accelerator pedal depression. Further, the high pressure oil manifold 15 is provided with a pressure sensor 24 and a temperature sensor 25 to detect the rail pressure in the high pressure oil manifold 15, an engine friction, and an oil temperature To representing the viscosity of the working fluid. In monitoring a value representing the engine friction, a water temperature sensor 23 attached to the cylinder head 3 may be used.

Along with other sensor signals representing when the piston in a reference cylinder or in each of the cylinders reaches the top dead center or a predetermined position before the top dead center, the crank angle detected by the crank angle sensor 21 is used for the control of the drive current supply start timing and period. The intake manifold 26 of the engine 1 is provided with an intake air pressure sensor 27 for detecting the pressure of air in the intake manifold 26 and an intake air temperature sensor 28 for detecting the temperature of the air drawn in. The opening degree of a throttle valve 29 installed in the intake manifold 26 is controlled by a control signal from the controller 20, and the throttle valve position is detected by a position sensor 30. To reduce NOx emissions an EGR (exhaust gas recirculation) pipe 32 for recirculating a part of the exhaust gas to the intake manifold 26 is connected between an exhaust manifold 31 and the intake manifold 26 of the engine 1. A valve lift position of an EGR valve 33 installed in the EGR pipe 32 is controlled by utilizing a negative pressure of a vacuum pump 34 as a vacuum source, the introduction of which is regulated by a pressure regulating valve (EVRV) 35 controlled by the controller 20. The valve lift position is detected as a valve lift negative pressure by an EGR pressure sensor 36. Further, the controller 20 is also supplied with signals from a shift position sensor 37 of an automatic transmission, a warming-up switch 38 operated to accelerate the warming up of the engine 1, and an air conditioner switch 39 for an air conditioner as an auxiliary device.

The intake air pressure sensor 27 is located downstream of a compressor of a turbocharger 19 in the intake manifold 26 and also upstream of an outlet of the EGR pipe 32 connecting the intake manifold 26 and the exhaust manifold 31. An atmospheric pressure sensor, while it may be installed separately, serves also as the EGR pressure sensor 36 in this embodiment. The EGR pressure sensor 36 monitors the operating pressure of the EGR valve 33 when the EGR is in operation and, when the EGR is not operating, functions as an atmospheric pressure sensor. Because the atmospheric pressure monitored when the EGR is turned off is stored in memory at predetermined intervals, if the intake air pressure sensor 27 is found abnormal or faulty during the operation of the EGR, the latest atmospheric pressure stored in memory can be used as an intake air pressure.

The injector 11 has the solenoid valve 17, which is arranged in such a manner as to open or close the oil path leading from the high pressure oil manifold 15 to the pressure chamber of the injector 11. The control of the operation of the solenoid valve 17 by the supply timing and duration of a control current from the controller 20 makes it possible to control the timing and duration of supplying the high pressure working oil into the pressure chamber of the injector 11 and therefore the injection timing and the amount of fuel to be injected from the injector 11. That is, the controller 20 determines the duration (pulse width) of current supplied to the solenoid valve based on the calculated target fuel injection amount and energizes the solenoid valve 17 with this pulse width to control the fuel injection amount. The controller 20 calculates a target fuel injection amount, a target fuel injection timing and a target fuel injection pressure according to the engine operating conditions and, based on these calculated target values, determines the timing and duration of energizing the solenoid valve 17 and the duty ratio of the flow control valve 16.

Figure 11:
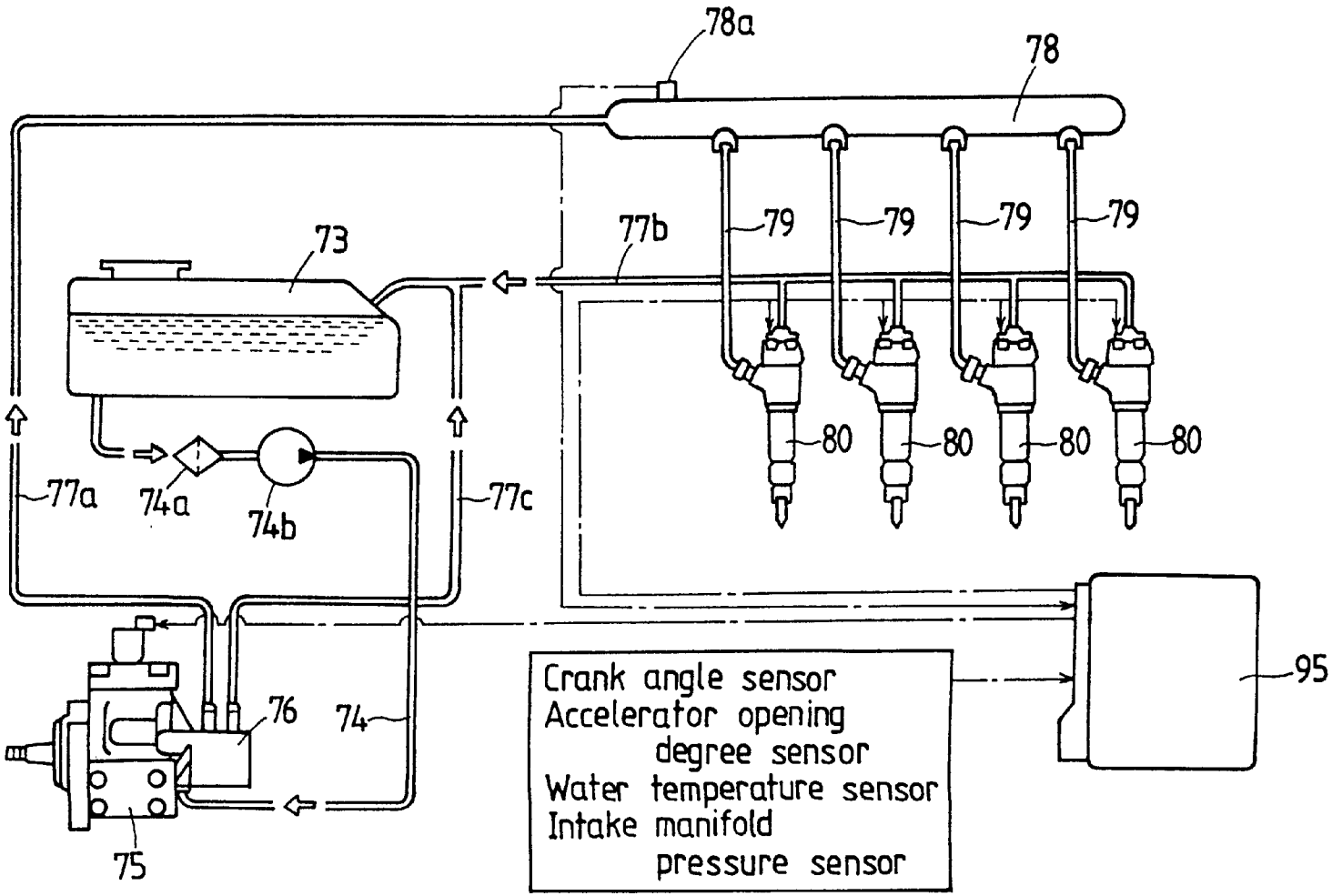
FIG. 11 is a schematic diagram showing one example of a fuel pressure activated type electronic control fuel injection system to which to apply the engine operation control device.

The fuel injection device is not limited to applications to the hydraulically activated type fuel injection system described above and may also be applied, for example, to the fuel pressure activated type electronic control fuel injection system shown in FIG. 11. FIG. 11 shows an outline configuration of one example of the fuel pressure activated type electronic control fuel injection system. The fuel supply to a plurality of injectors 80 is from the common rail 78 through fuel feed pipes 79. The fuel is drawn from a fuel tank 73 through a filter 74*a* by a feed pump 74*b* and pressurized to a predetermined pressure and then delivered through a fuel pipe 74 to a high-pressure fuel pump 75. The high-pressure fuel pump 75 is a so-called plunger type fuel feed pump, which is driven, for instance, by engine to raise the fuel pressure to a high pressure level, which is determined according to the operating condition, and to feed the pressurized fuel through a fuel pipe 77*a* to the common rail 78. The fuel thus supplied is stored at the predetermined elevated pressure in the common rail 78, from which it is further supplied to each injector 80. Normally, two or more injectors 80 are provided according to the type of engine (number of cylinders). Under the control by a controller 95, the injectors inject the fuel supplied from the common rail 78 into the associated combustion chambers at optimal timings and in optimal amounts. Because the injection pressure of the fuel injected from the injector 80 is virtually equal to the pressure of the fuel stored in the common rail 78, the control of the injection pressure is achieved by controlling a flow control valve 76 to control the amount of high pressure fuel supplied to the common rail 78 and therefore the fuel pressure of the common rail 78.

The fuel released from the high-pressure fuel pump 75 is returned to the fuel tank 73 through a return pipe 77*c*. Of the fuel supplied to the injectors 80 through the fuel feed pipes 79, the fuel that is not used for injection into the combustion chambers is returned to the fuel tank 73 through return pipes 77*b*. The controller 95 receives signals from various sensors shown in FIG. 9 that represent the engine operating conditions, these sensors including a crank angle sensor for detecting the engine revolution speed Ne, an accelerator opening degree sensor for detecting the accelerator depression amount Ac, a water temperature sensor for detecting the cooling water temperature, and an intake manifold inner pressure sensor for detecting the pressure in the intake manifold. The controller 95, based on these signals, controls the fuel injection characteristics of the injectors 80, i.e., the fuel injection timing and amount, so that the engine output is optimal for the engine operating condition. The common rail 78 has a pressure sensor 78*a* which sends its detection signal representing the fuel pressure in the common rail 78 to the controller 95. The controller 95 controls the delivery pressure of the high-pressure fuel pump 75 so that the fuel pressure in the common rail 78 remains constant even when the fuel in the common rail 78 is consumed by the fuel injection from the injectors 80.

Figure 1:
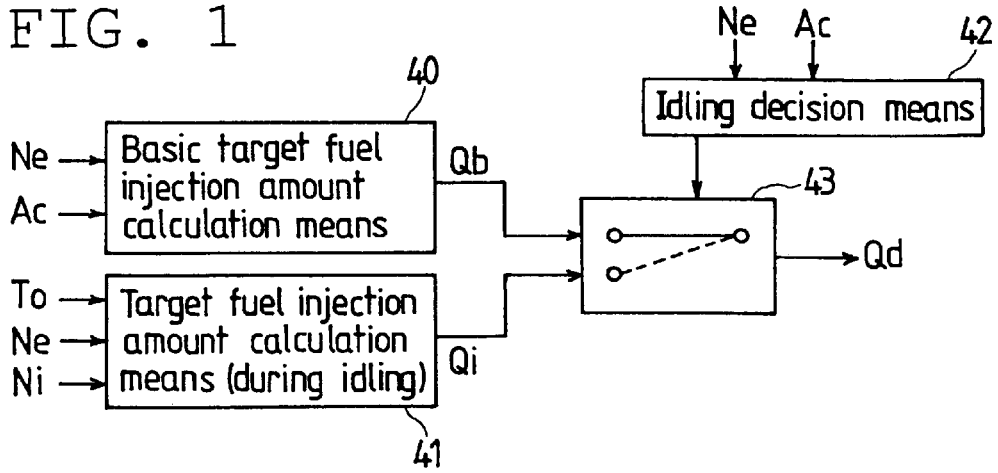
FIG. 1 is a block diagram showing a final target fuel injection amount calculation concept applied to an engine operation control device of this invention.

As shown in FIG. 1, when the engine 1 is operating in the non-idling state, a basic target fuel injection amount calculation means 40 references data such as map, which was preset according to the engine revolution speed Ne and the accelerator depression amount Ac, and calculates a basic target fuel injection amount Qb corresponding to the operating condition. When the engine 1 is idling, a target fuel injection amount calculation means 41 calculates a target fuel injection amount Qi by the PID control according to the oil temperature To, the engine revolution speed Ne and the target revolution speed Ni for idling. In more concrete terms, an injection correction amount, which is corrected by the PID control based on the revolution speed difference $\Delta N$ (=Ne−Ni), is determined for the basic fuel injection amount that is obtained from the oil temperature To. The injection correction amount is added to the basic fuel injection amount to obtain the target fuel injection amount Qi.

The idling decision means 42 determines, based on the engine revolution speed Ne and the accelerator depression amount Ac, whether the engine 1 is in the idling state or the non-idling state. That is, when the engine revolution speed Ne is in a predetermined low speed range and the accelerator depression amount Ac (accelerator opening degree) is at a predetermined low depression amount (low opening degree, for example, 0% opening), it is decided that the engine 1 is idling. In other operating conditions, the engine 1 is decided to be in the non-idling state. When the engine 1 is in the non-idling state, a selector 43 is operated to output the basic target fuel injection amount Qb. When the engine 1 is in the idling state, the target fuel injection amount Qi for the idling operation is output. The fuel injection amount thus output (Qb or Qi) is corrected according to the intake air temperature to obtain the final target fuel injection amount Qd. The controller 20 performs the calculation of the target fuel injection amount at predetermined intervals (or every predetermined crank angle). At a predetermined crank angle before the fuel injection in each cylinder, the controller 20 executes an interrupt processing to determine the pulse width of a control current supplied to the solenoid valve 17 of the injector 11 according to the final target fuel injection amount Qd.

Figure 4:
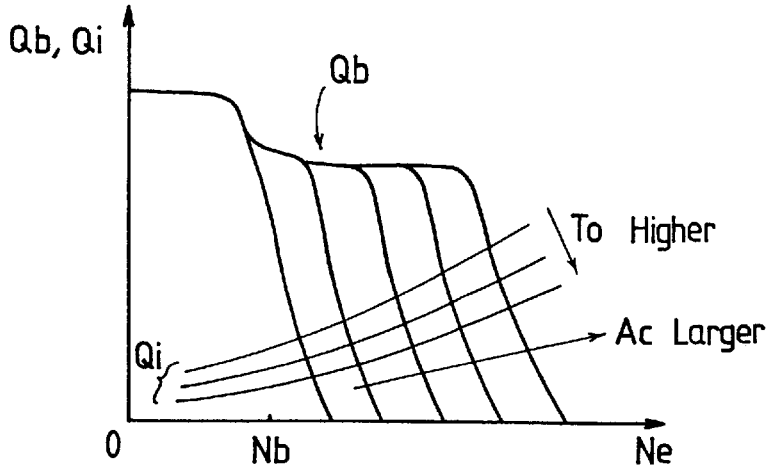
FIG. 4 is a graph showing the relation between the engine revolution speed and the fuel injection amount during the idling operation and during the non-idling operation.

FIG. 4 is a graph showing the relation between the engine revolution speed Ne and the target fuel injection amount Qi for the idling operation and between the engine revolution speed Ne and the basic target fuel injection amount Qb for the non-idling operation. The graph for the basic target fuel injection amount Qb shows that as the accelerator depression amount Ac increases, there is a greater basic target fuel injection amount Qb even at a large engine revolution speed. It also shows that the target fuel injection amount Qi increases with the engine revolution speed Ne and that a higher oil temperature To results in a reduced fuel injection amount.

Figure 2:
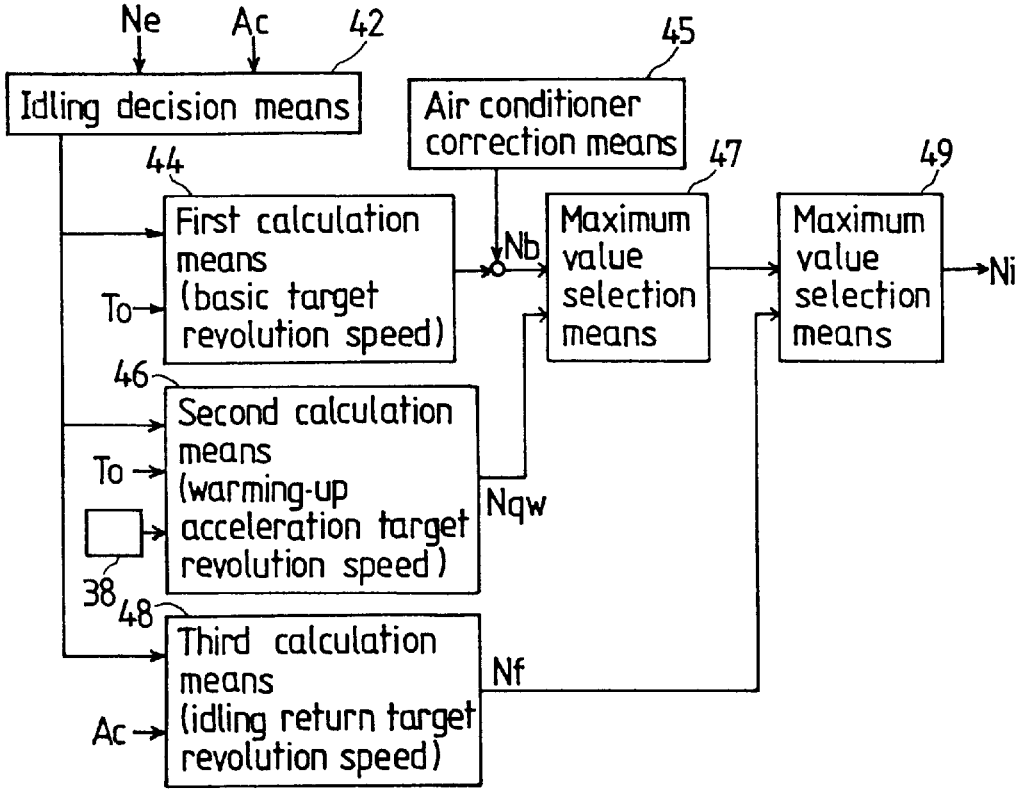
FIG. 2 is a block diagram showing a concept for calculating a target revolution speed for idling in the engine operation control device of this invention.

As shown in FIG. 2, a first calculation means 44 for calculating the basic target revolution speed computes, based on data such as map, a basic target revolution speed Nb that corresponds to the oil temperature To detected by the temperature sensor 25. The basic target revolution speed Nb is set higher as the oil temperature To becomes lower. The basic target revolution speed Nb is corrected according to the working condition of the air conditioner. That is, when the air conditioner switch 39 is on, a revolution correction amount calculated by an air conditioner correction means 45 is added for determining the basic target revolution speed Nb. When the air conditioner switch 39 is off, the correction amount is zero and thus the revolution speed calculated by the first calculation means 44 is the basic target revolution speed Nb.

A second calculation means 46 calculates a warming-up acceleration target revolution speed Nqw according to whether the warming-up switch 38 is on or off and corresponding to the oil temperature To at that time. The warming-up acceleration target revolution speed Nqw is set higher than the basic target revolution speed Nb. A maximum value selection means 47 selects the basic target revolution speed Nb or the warming-up acceleration target revolution speed Nqw, whichever is larger. A third calculation means 48 calculates, based on the information on the accelerator depression amount Ac, an idling return target revolution speed Nf of this invention, which is a target revolution speed when the engine returns from the non-idling state to the idling state. A maximum value selection means 49 selects the revolution speed chosen by the maximum value selection means 47 or the idling return target revolution speed Nf, whichever is larger, and outputs a final target revolution speed Ni for the idling operation. The target revolution speed Ni is used as input data for the target fuel injection amount calculation means 41. The means 44–46 shown in FIG. 2 only perform calculations when the engine 1 is operating in the idling state, whereas the third calculation means 48 performs calculations even when the engine 1 is in the non-idling state.

Figure 3:
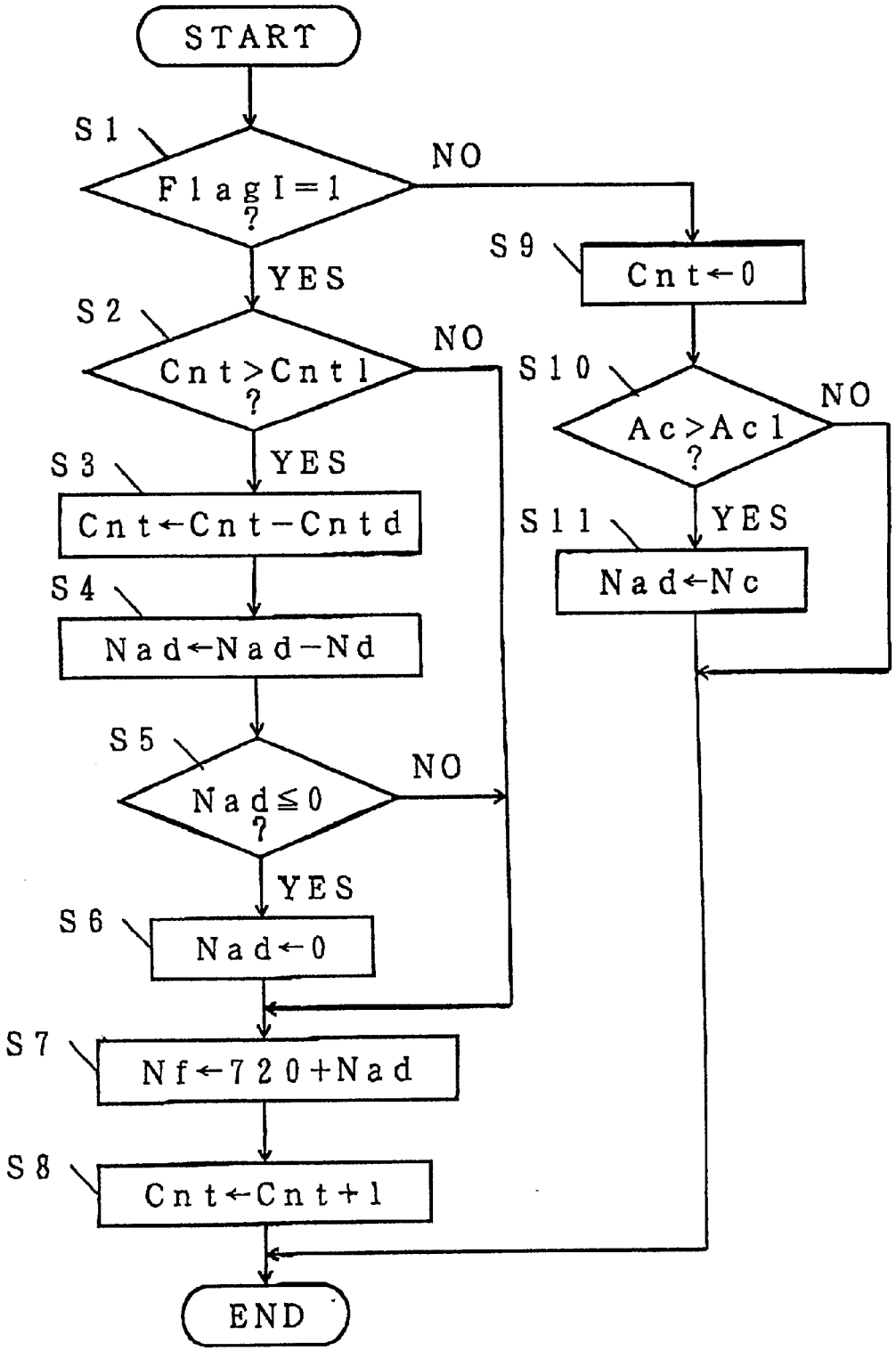
FIG. 3 is a flow chart showing a routine performed by the engine operation control device of this invention for calculating the target revolution speed of the engine immediately after shifting to the idling operation.

FIG. 3 is a flow chart showing a routine executed by the engine operation control device of this invention to calculate the engine target revolution speed immediately after the engine has shifted to the idling operation. The routine for calculating the idling return target revolution speed Nf, an engine target revolution speed immediately after the return to the idling operation, is executed by the third calculation means 48 of FIG. 2. This flow chart comprises the following steps (S1–S11).

(1) A decision is made on whether an idling flag FlagI is set by the idling decision means 42 (S1).

(2) If the idling flag FlagI is found to be set by the S1 decision (engine is in the idling state), a count value Cnt (initial value is 0; it may have already been counted up) of an idling counter, which is counted up every time this routine is executed, is compared with a predetermined set value Cnt1 (S2).

(3) If the comparison in S2 has found that the count value Cnt is larger than the set value Cnt1, a predetermined value Cntd is subtracted from the current count value Cnt and the resulting value is used as a new count value Cnt (S3), as shown in the following expression.

$$Cnt \leftarrow Cnt - Cntd$$

(4) At the same time that the count value is processed in S3, a predetermined value Nd is subtracted from a revolution speed correction amount Nad and the resultant is used as a new correction amount Nad (S4). This routine is repetitively executed every predetermine time (or predetermined crank angle) and, as described later, the count value Cnt repetitively increases and decreases each time S3 and S8 are executed. Each time the count value Cnt, after it has increased, is found to be larger than the set value Cnt1 by the S2 decision, the correction amount Nad becomes progressively smaller.

$$Nad \leftarrow Nad - Nd$$

(5) After S4, a check is made of whether the revolution speed correction amount Nad has become not larger than 0 (S5).

(6) When the revolution speed correction amount Nad is found to be not more than 0 by the S5 decision, 0 is substituted into the correction amount Nad (S6). That is, because this control flow performs only the correction that increases the revolution speed and not the one that reduces the revolution speed, when the correction amount Nad is calculated to be 0 or less in step S4, the correction amount Nad is set to 0.

(7) When, during the repetitive execution of this routine with the elapse of time, the comparison in step S2 determines that the count value Cnt is not greater than the set value Cnt1, steps S3–S6 are skipped. When step S5 finds the correction amount Nad to be a positive value, step S6 is skipped. In the above two cases and also in a case where step S6 sets the correction amount Nad to 0, this routine moves to the next step which substitutes into the idling return target revolution speed Nf a standard idling target revolution speed (which corresponds to the basic target revolution speed after the warm-up is complete; in this example, 720 rpm) plus the correction amount Nad.

$$Nf \leftarrow 720 + Nad$$

That is, when the comparison in step S2 determines that the count value Cnt is equal to or less than the set value Cnt1, this represents a case where although the Cnt has been counted up, the idling target revolution speed is corrected by the same correction amount Nad that was used at the previous count value. When step S5 decides that the correction amount Nad is a positive value, this represents a case where the correction amount Nad was reduced in step S4 but is still a positive value and the idling target revolution speed is corrected by the reduced correction amount Nad. Further, when the correction amount Nad is set to 0 in step S6, this represents a case where the correction of the target revolution speed at the time of shift to the idling operation is terminated.

(8) After step S7, the count value Cnt is incremented by 1 before ending this routine (S8).

(9) When step S1 decides that the idling flag FlagI is not set (FlagI=0), i.e., the engine operation is in the non-idling state, the count value Cnt of the idling counter is cleared to 0 (S9). Only when the engine operating state shifts to the idling state, does the S1 decision follow the YES branch to count up the count value Cnt in step S8.

(10) A decision is made on whether the accelerator depression amount Ac exceeds a predetermined accelerator depression amount Ac1 (S10).

(11) When step S10 decides that the accelerator depression amount Ac is in excess of the Ac1, this means that the engine is running under the normal operating condition with a large accelerator depression. In this case, a predetermined value Nc is substituted into the revolution speed correction amount Nad (S11). That is, when during the non-idling operation the accelerator depression amount Ac exceeds the Ac1 to perform a high load operation even once, the correction amount Nad immediately after the return to the idling state is set with a predetermined initial value. When, after the engine has shifted to the idling operation, step S1 decides that the idling flag FlagI is set, step S4 repetitively subtracts one predetermined value Nd at a time from the correction amount Nad, which was set to the predetermined value Nc in step S11, for the duration of an elapsed time after the return to the idling operation during which time the decision of step 2 follows the YES branch. When step 10 decides that the accelerator depression amount Ac is not greater than the Acd, this routine is terminated.

Figure 5:
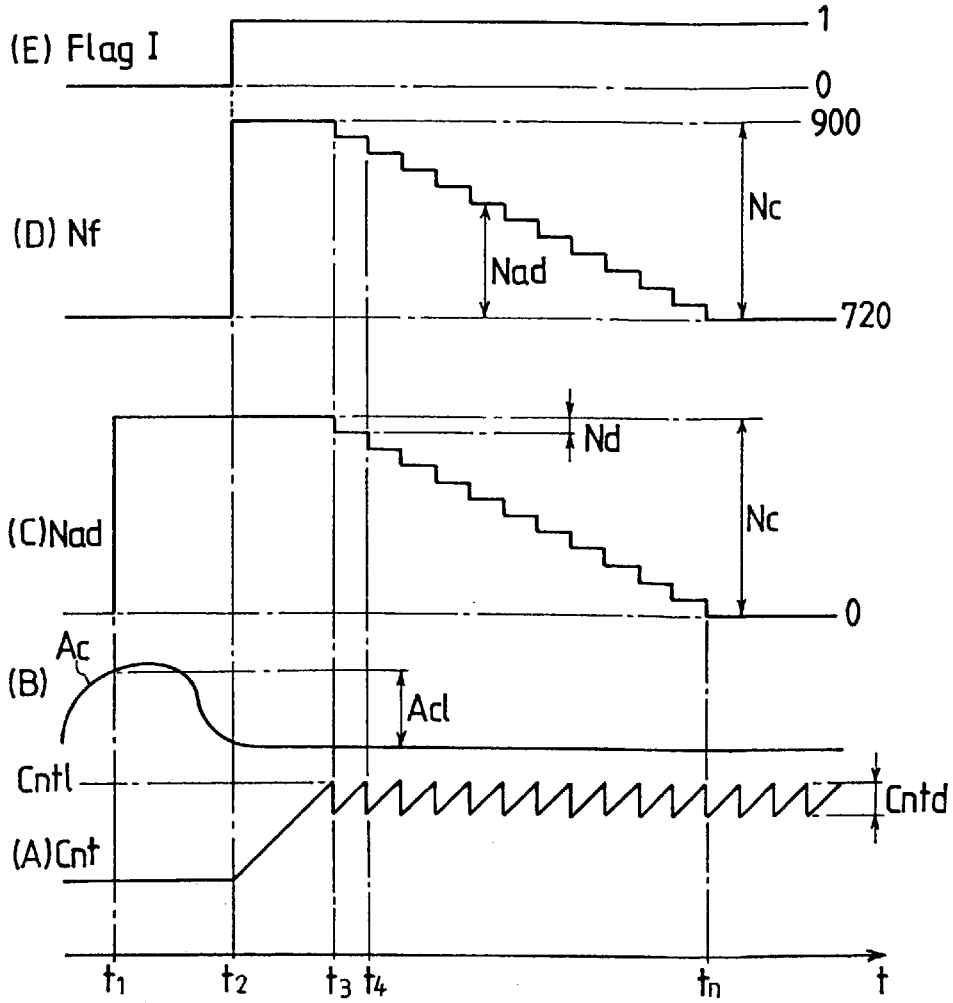
FIG. 5 is graphs showing an example of changes over time of a count value of an idle counter, an accelerator depression amount, a revolution speed correction amount, a target revolution speed upon return to idling and an idling flag when the calculation routine of FIG. 4 is executed.

FIG. 5 is graphs showing an example of changes over time of the count value Cnt of the idling counter, the accelerator depression amount Ac, the revolution speed correction amount Nad, the idling return target revolution speed Nf and the idling flag FlagI when the routine for calculating the idling return target revolution speed shown in FIG. 4 is executed. Graphs (A), (B), (C), (D) and (E), from bottom to top, respectively represent a change in the idling counter's count value Cnt, a change in the accelerator depression amount Ac, a change in the engine revolution speed correction amount Nad, a change in the corrected idling return target revolution speed Nf, and the idling flag FlagI set by the idling decision means.

In the graph (B), when during normal operation (non-idling operation) step S10 decides that the accelerator depression amount Ac exceeds the predetermined accelerator depression amount Acd at time $t_1$, the engine revolution speed correction amount Nad to be added is set to Nc as an initial value (S11). At this time, the idling counter count value Cnt remains 0 and the idling return target revolution speed Nf has a value of 720. Then, when the engine revolution speed and the accelerator depression amount decrease and at time $t_2$ the engine operation shifts to the idling state, step S1 sets the idling flag FlagI to 1 and, as shown in graph (E), the value of FlagI changes stepwise from 0 to 1. When this routine moves to step S2 for the first time, the count value Cnt is less than the set value Cnt1, so that the first decision made in step S2 is NO. Thus, in step S7 the idling return target revolution speed Nf is set to 720+Nad (i.e., 720+Nc, about 900 rpm) and in step S8 the count value Cnt starts to be counted up.

As the count value Cnt is counted up, the count value Cnt exceeds the set value Cnt1 at time $t_3$, at which time the decision in step S2 becomes YES with the result that step S3 subtracts a predetermined value Cntd from the count value Cnt. Further, at step S4 a predetermined value Nd is subtracted from the correction amount Nad. At the first execution of this routine the correction amount Nad is more than 0, so that at step S7 the idling return target revolution speed Nf is set to the subtracted correction amount Nad added to the standard idling target revolution speed (720). During the next execution of this routine, because the count value Cnt was subtracted by the predetermined value Cntd, the decision in step S2 is NO and step S7 maintains the idling return target revolution speed Nf that was corrected by the subtracted correction amount Nad. After time $t_3$, the count value Cnt starts increasing and when at time $t_4$ the count value Cnt exceeds the set value Cnt1, the above processing is performed again to correct the idling return target revolution speed Nf by the correction amount Nad which is further reduced by the predetermined value Nd. While the engine continues the idling operation, the above processing is repeated causing the idling return target revolution speed Nf to decrease progressively as shown in graph (D). At time $t_n$, when Nad becomes equal to or lower than 0 as a result of the execution of step S4, step S6 sets the correction amount Nad to 0, which is equivalent to the idling return target revolution speed Nf remaining uncorrected. Hence, as long as the idling operation is continued (that is, the decision of S1 is YES), the idling return target revolution speed Nf remains constant at 720 (rpm).

Figure 6:
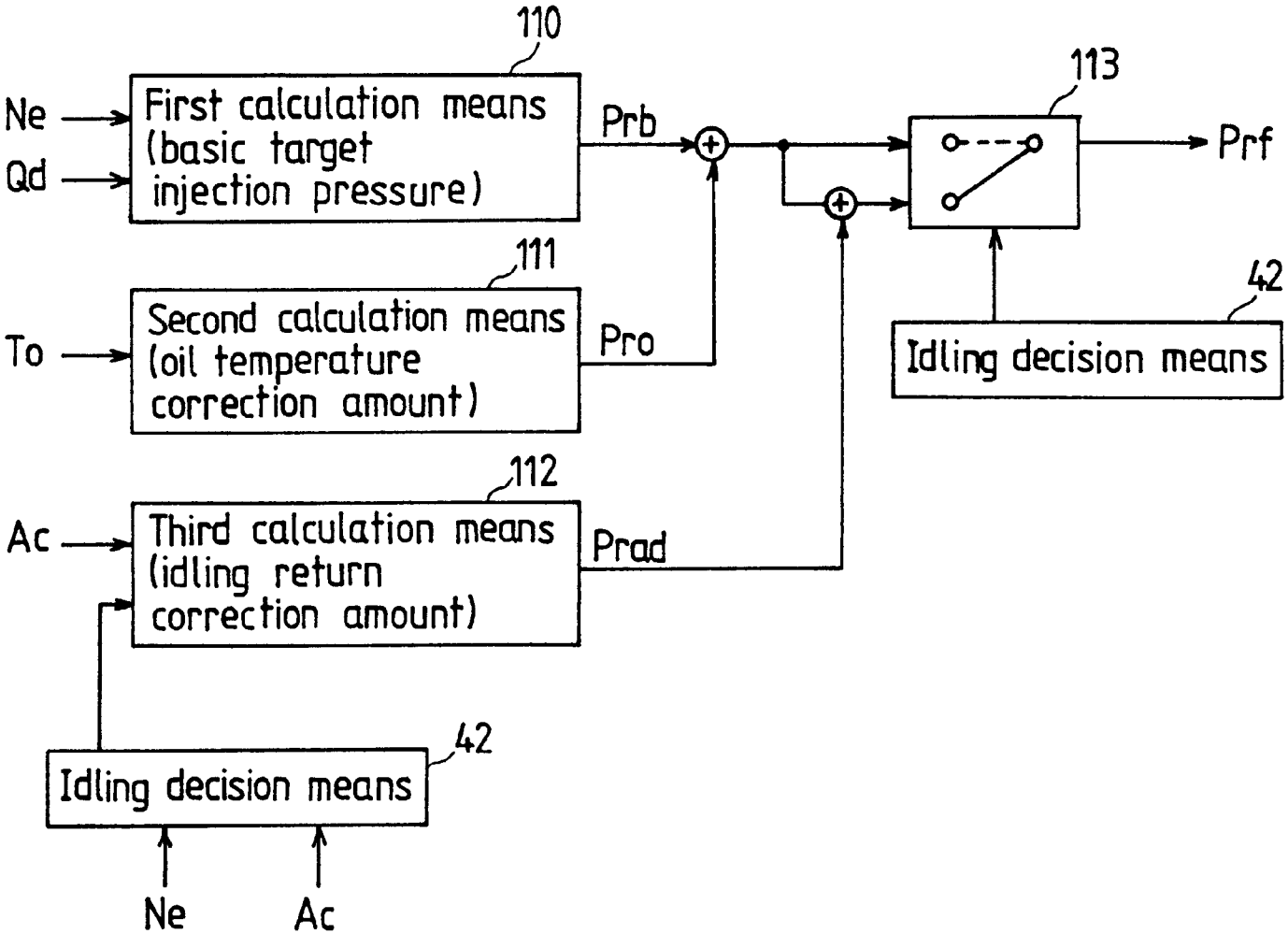
FIG. 6 is a block diagram showing a concept for calculating a target injection pressure for idling in another embodiment of the engine operation control device.

The embodiment shown in FIGS. 2, 3 and 5 controls the engine operation upon return to the idling state by using the revolution speed as a quantity to be controlled. An embodiment shown in FIGS. 6 to 8 controls the engine operation upon return to the idling state by using the injection pressure as a controlled quantity. FIG. 6 is a block diagram showing a concept for calculating the target injection pressure during the idling operation in the engine operation control device of a second invention. A first calculation means 110, in response to the input of the engine revolution speed Ne and the final target fuel injection amount Qd, calculates a basic target injection pressure Prb based on predetermined data such as map. A second calculation means 111 calculates a correction amount (oil temperature correction amount Pro) for the basic target injection pressure Prb according to the predetermined data such as map by using the oil temperature To of the lubricating oil (engine oil) detected by the temperature sensor 25. The oil temperature correction amount Pro for the injection pressure is set higher as the oil temperature To becomes lower. A third calculation means 112 calculates a correction amount (idling return correction amount Prad) which is used to correct the basic target injection pressure Prb upon return to the idling operation. That is, when the idling decision means 42 decides, based on the engine revolution speed Ne and the accelerator depression amount Ac, that the engine is running in the idling state, the third calculation means 112 calculates the idling return correction amount Prad for the injection pressure that is used when the engine returns from the non-idling state to the idling state. In the hydraulically activated type fuel injection system, the control of the pressure of the engine oil as the working fluid allows the fuel injection pressure that is pressurized by the oil pressure to be controlled. Hence, the injection pressure includes the engine oil pressure as the working fluid.

Under normal conditions, the oil temperature correction amount Pro calculated by the second calculation means 111 is added to the basic target injection pressure Prb calculated by the first calculation means 110. During the non-idling operation, a switching circuit 113 in response to a signal from the idling decision means 42 outputs as a final target injection pressure Prf the basic target injection pressure Prb plus the oil temperature correction amount Pro. During the idling operation, the third calculation means 112 calculates the idling return correction amount Prad, and at the same time the switching circuit 113, in response to a signal from the idling decision means 42, adds the idling return correction amount Prad calculated by the third calculation means 112 to the sum of the basic target injection pressure Prb and the oil temperature correction amount Pro and then outputs the result of addition as the final target injection pressure Prf. The controller 20 determines a duty ratio of the flow control valve 16 and others (see FIG. 9) so that the pressure of the working fluid will be equal to the final target injection pressure Prf and then, based on the duty ratio, controls the flow control valve 16. Hence, the pressure of the working fluid upon return to the idling operation will be higher than that during the normal idling operation. That is, because the amount of pressure reduction is suppressed to a smaller value, generation of bubbles is minimized.

Figure 7:
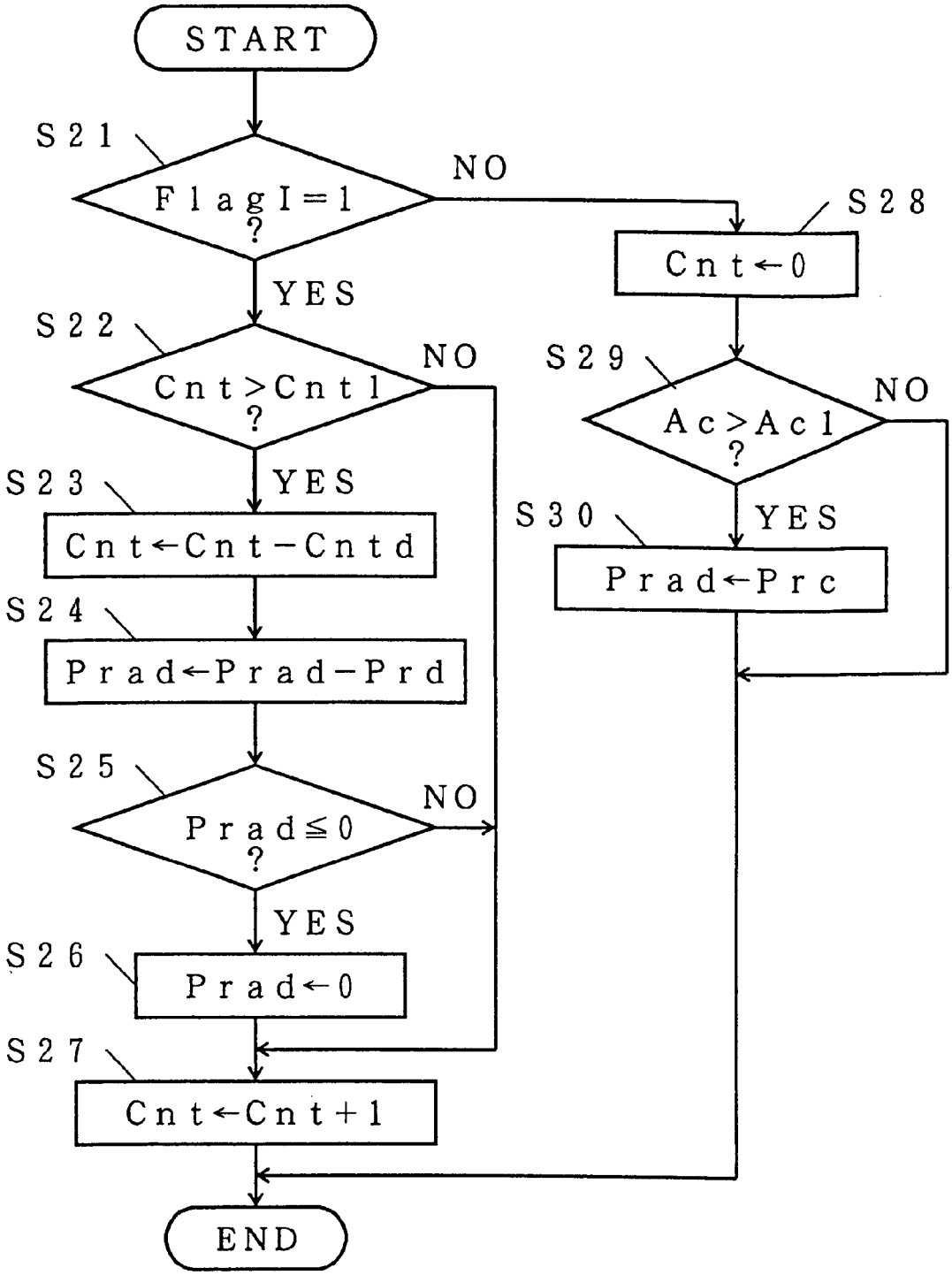
FIG. 7 is a flow chart showing a routine performed by another embodiment of the engine operation control device for calculating the target injection pressure of the engine immediately after shifting to the idling operation.

FIG. 7 is a flow chart showing a routine performed by the engine operation control device of this invention to calculate the target injection pressure of the engine immediately after shifting to the idling operation. The routine for calculating the idling return correction amount for the injection pressure immediately after the engine has shifted to the idling operation (hereinafter referred to simply as a correction amount in the following explanation of this flow chart) is executed by the third calculation means 112 shown in FIG. 6. This flow chart comprises the following steps (S21–S30).

(1) The idling decision means 42 checks whether the idling flag FlagI is set or not (S21).

(2) If step S21 has found that the idling flag FlagI is set (engine is idling), the count value Cnt of the idling counter that is counted up every time this routine is executed is compared with a predetermined set value Cnt1 (S22).

(3) If the comparison by S22 has found that the count value Cnt is larger than the set value Cnt1, a predetermined value Cntd is subtracted from the current count value Cnt and the resulting value substitutes as a new count value Cnt (S23), as shown in the following expression.

$$Cnt \leftarrow Cnt - Cntd$$

(4) After the count value is processed by S23, a predetermined value Prd is subtracted from the correction amount Prad for the injection pressure and the resulting value substitutes as a new correction amount Prad (S24). This routine is executed at predetermined intervals (or every predetermined crank angle). Each time steps S23 and S27 are executed, the count value Cnt is repetitively increases or decreases. Each time the count value Cnt increases and is decided by step S22 to exceed the set value Cnt1, the correction amount Prad becomes progressively smaller.

$$Prad \leftarrow Prad - Prd$$

(5) After the processing by S24, a check is made to see whether the injection pressure correction amount Prad is 0 or less (S25).

(6) When step S25 decides that the injection pressure correction amount Prad is 0 or less, 0 is substituted into the correction amount Prad (S26). That is, because the injection pressure correction performed in this control flow is a correction only for increasing the injection pressure, not decreasing it, when the correction amount Prad obtained by step S24 is 0 or less, the correction amount Prad is set to 0.

(7) When, during the repetitive execution of this routine with the elapse of time, the comparison in step S22 determines that the count value Cnt is not greater than the set value Cnt1, steps S23–S26 are skipped. When step S25 finds the correction amount Prad to be a positive value, step S26 is skipped. In the above two cases and also in a case where step S26 sets the correction amount Prad to 0, this routine moves to the next step to count up the count value Cnt by 1 before ending (S27). That is, when the comparison by step S22 determines that the count value Cnt is equal to or less than the set value Cnt1, this represents a case where although the Cnt has been counted up, the idling target injection pressure is corrected by the same correction amount Prad that was used at the previous count value. When step S25 decides that the correction amount Prad is a positive value, this represents a case where the correction amount Prad was reduced in step S24 but is still a positive value and the idling target injection pressure is corrected by the reduced correction amount Prad. Further, when the correction amount Prad is set to 0 by step S26, this represents a case where the correction of the target injection pressure at the time of shift to the idling operation is terminated. At this time, the idling return correction amount Prad calculated by the third calculation means 112 is added to the basic target injection pressure Prb calculated by the first calculation means 110 to determine a final target injection pressure Prf. The controller 20 controls the duty ratio of the flow control valve 16 and others (see FIG. 9) so that the pressure of the working fluid will be equal to the final target injection pressure Prf.

(8) When step S21 decides that the idling flag FlagI is not set (FlagI=0), i.e., when the engine operation is in the non-idling state, the count value Cnt of the idling counter is cleared to 0 (S28). Only when the engine operation shifts to the idling state, does the S21 decision follow the YES branch to count up the count value Cnt at step S27.

(9) A decision is made on whether the accelerator depression amount Ac exceeds a predetermined accelerator depression amount Acd (S29).

(10) When step S29 decides that the accelerator depression amount Ac is in excess of the Ac1, this means that the engine is running under the normal operating condition with a large accelerator depression. When during the non-idling operation the accelerator depression amount Ac exceeds the Ac1 to perform a high load operation even once, a predetermined value Prc is substituted as the injection pressure correction amount Prad (S30). When step S29 decides that the accelerator depression amount Ac is not in excess of the Ac1, this routine is ended.

As already described, when the engine shifts to the idling operation and the idling flag FlagI is found set at step S21, the correction amount Prad which was set to the predetermined value Prc gets subtracted progressively every time the decision of step S21 becomes YES at step S24.

Figure 8:
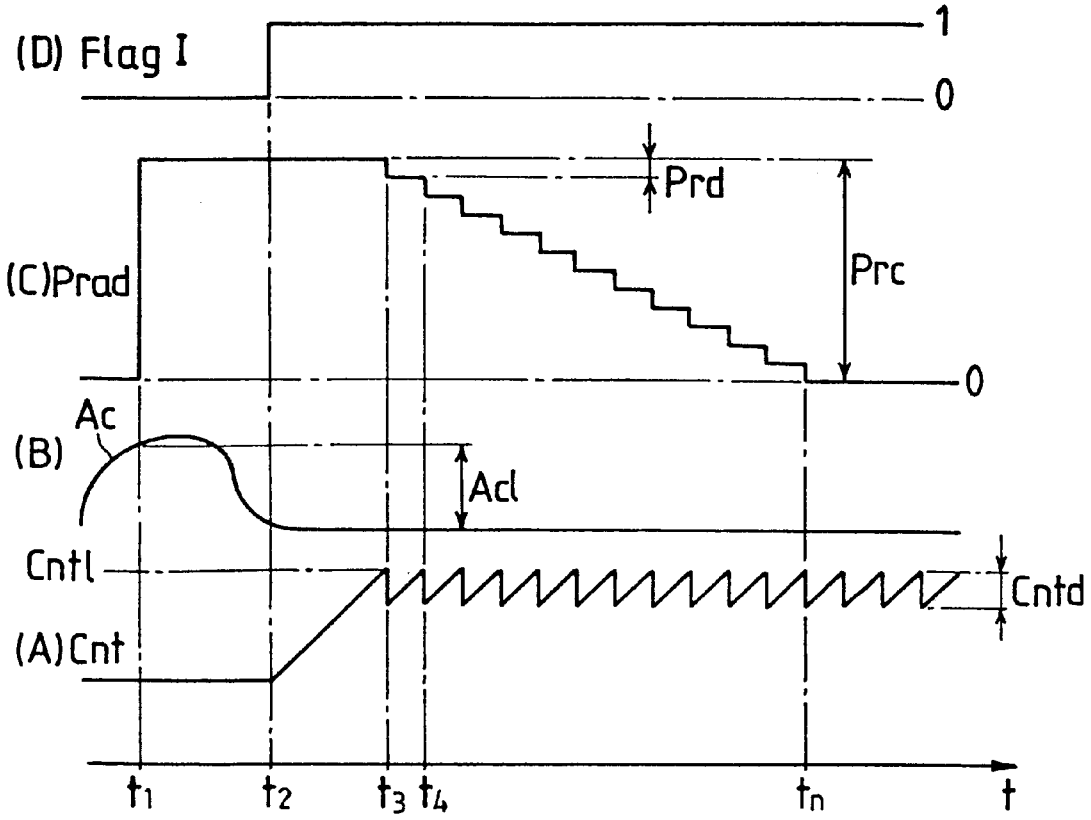
FIG. 8 is a graph showing one example of a count value of the idle counter, an accelerator depression amount, an injection pressure correction amount and a change over time of an idling flag when the calculation routine of FIG. 7 is executed.

FIG. 8 is graphs showing one example of changes over time of the idling counter count value Cnt, the accelerator depression amount Ac, the injection pressure correction amount Prad, and idling flag FlagI when the routine of FIG. 7 for calculating the target injection pressure upon return to the idling operation is executed. Graphs (A), (B), (C) and (D), from bottom to top, respectively represent a change in the idling counter's count value Cnt, a change in the accelerator depression amount Ac, a change in the injection pressure correction amount Prad, and the idling flag FlagI set by the idling decision means.

In the graph (B), when during normal operation (non-idling operation) step S29 decides that the accelerator depression amount Ac exceeds the predetermined accelerator depression amount Ac1 at time $t_1$, the injection pressure correction amount Prad to be added is set to Prc as an initial value (S30). At this time, the idling counter count value Cnt remains at 0. Then, when the engine revolution speed Ne and the accelerator depression amount Ac decrease and at time $t_2$ the engine operation shifts to the idling state, step S21 sets the idling flag FlagI to 1 and, as shown in graph (E), the value of FlagI changes stepwise from 0 to 1. When this routine moves to step S22 for the first time, the count value Cnt is less than the set value Cnt1, so that the first decision made by step S22 is NO. Thus, at step S27 the count value Cnt starts to be counted up.

As the count value Cnt is counted up, the count value Cnt exceeds the set value Cnt1 at time $t_3$, at which time the decision of step S22 becomes YES with the result that step S23 subtracts a predetermined value Cntd from the count value Cnt. Further, at step S24 a predetermined value Prd is subtracted from the correction amount Prad. At the first execution of this routine the correction amount Prad is more than 0, so that the subtracted correction amount Prad is added to the basic target injection pressure Prb that is used upon return to the idling operation. During the next execution of this routine, because the count value Cnt was subtracted by the predetermined value Cntd, the decision of step S22 is NO and the final target injection pressure Prf that was corrected by the subtracted correction amount Prad is maintained. After time $t_3$, the count value Cnt starts increasing and when at time $t_4$ the count value Cnt exceeds the set value Cnt1, the above processing is performed again to correct the final target injection pressure Prf used after return to idling by the correction amount Prad which is further reduced by the predetermined value Prd. While the engine continues the idling operation, the above processing is repeated, and at time $t_n$, when the correction amount Prad becomes equal to or less than 0 as a result of the execution of step S24, step S26 sets the correction amount Prad to 0, which is equivalent to the basic target injection pressure Prb after return to idling remaining uncorrected.

Figure 12:
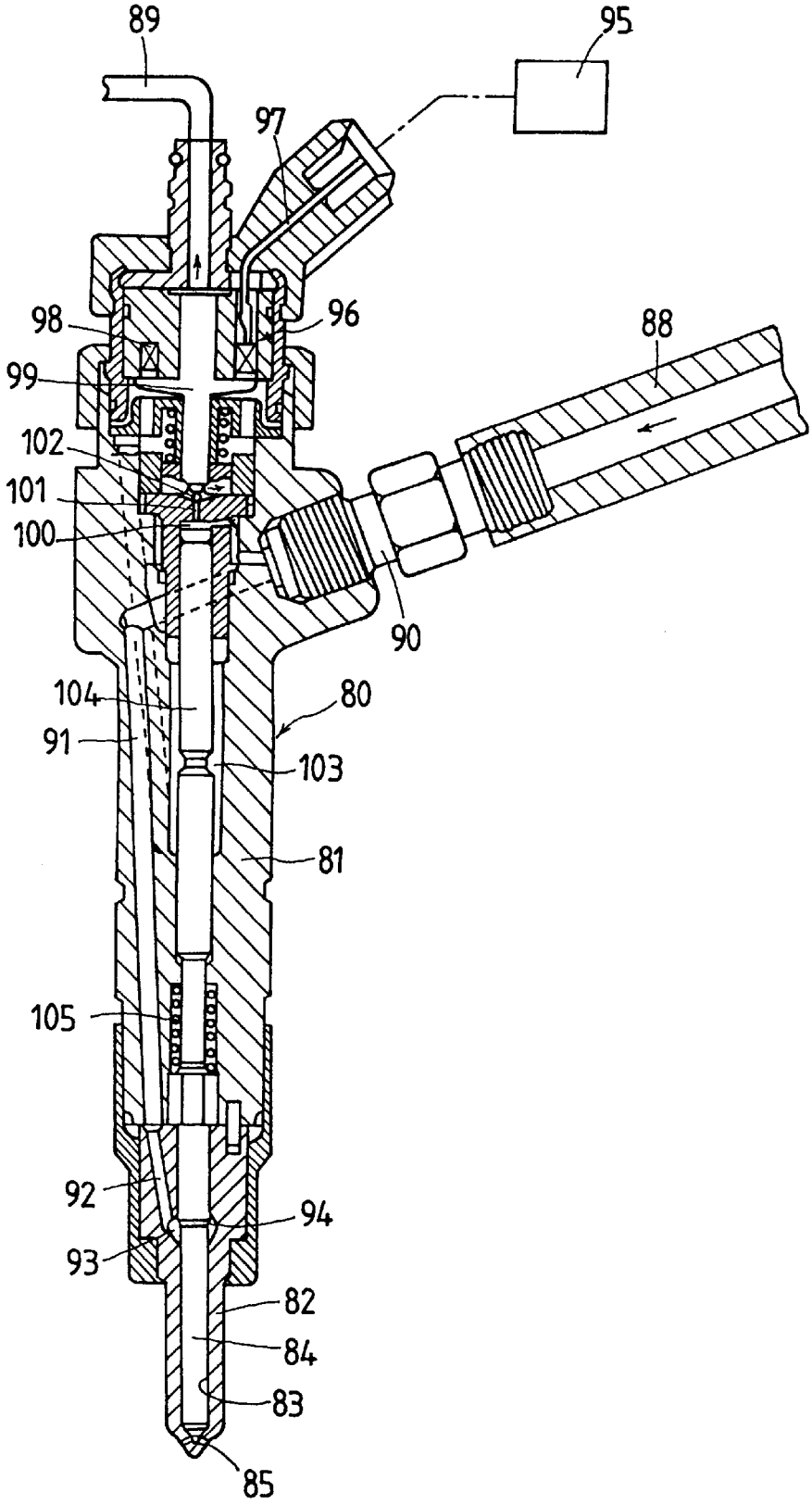
FIG. 12 (PRIOR ART)
FIG. 12 is a cross section showing one example of a pressure control chamber type injector used in the electronic control fuel injection system.

The engine operation control device of this invention as applied to the hydraulically activated electronic control fuel injection system has been described. It is obvious that the engine operation control device of this invention can also be applied to the fuel pressure activated type electronic control fuel injection system such as shown in FIGS. 11 and 12. When the device is applied to the fuel pressure activated type electronic control fuel injection system, the embodiment that corrects the engine target revolution speed as shown in FIGS. 1 through 5 can virtually be applied without any correction. Where the engine injection pressure is corrected as shown in FIGS. 6 to 8, the target fuel pressure as the working fluid needs to be corrected.

What is claimed is:

1. A diesel engine operation control device on a diesel engine in which a fuel-injection pressure decreases depending on a reduction in a load applied on the engine, comprising:

a target revolution speed calculation means for calculating a target revolution speed of the diesel engine according to an operation state of the engine; and a revolution speed correction means for correcting the target revolution speed of the diesel engine immediately after the engine operation state has shifted from a non-idling state to an idling state so that the target revolution speed will be higher than that which is calculated by the target revolution speed calculation means for the idling state.

2. A diesel engine operation control device according to claim 1, wherein the revolution speed correction means progressively reduces a correction amount with the elapse of time after the engine operation state has shifted to the idling state.

3. A diesel engine operation control device according to claim 1 and 2, wherein the engine adopts a fuel injection system which enables injection pressures of fuel injected from injectors to be regulated according to a pressure of a working fluid.

4. A diesel engine operation control device according to claim 2, further comprising fuel injection means for enabling injection pressures of fuel injected from injectors to be regulated according to a pressure of a working fluid.

* * * * *